United States Patent [19]

Newby et al.

[11] 4,169,424

[45] Oct. 2, 1979

[54] TENSION LEG BUOYANCY STRUCTURE

[75] Inventors: Maurice P. Newby, Helensburgh; Roderick C. T. Rainey, Glasgow, both of Scotland

[73] Assignee: Yarrow and Company Limited, Glasgow, Scotland

[21] Appl. No.: 714,824

[22] Filed: Aug. 16, 1976

[30] Foreign Application Priority Data

Aug. 14, 1975 [GB] United Kingdom ..... 33982/75

[51] Int. Cl.[2] ..... B63B 35/44

[52] U.S. Cl. ..... 114/265; 405/224

[58] Field of Search ..... 114/256, 264, 265, 266, 114/267, 293, 294; 61/86, 98; 405/224

[56] References Cited

U.S. PATENT DOCUMENTS

| | | | |
|---|---|---|---|
| 2,939,291 | 6/1960 | Scherman et al. | 114/265 |
| 3,224,401 | 12/1965 | Kobus | 114/265 |
| 3,577,946 | 5/1971 | Horton | 114/265 |
| 3,648,638 | 3/1972 | Blenkarn | 114/265 |
| 3,774,563 | 11/1973 | Anderson et al. | 114/256 |
| 3,885,511 | 5/1975 | Wipkink et al. | 114/265 |

*Primary Examiner*—Trygve M. Blix
*Assistant Examiner*—Sherman D. Basinger
*Attorney, Agent, or Firm*—Mason, Fenwick & Lawrence

[57] ABSTRACT

A tension leg buoyancy structure for use in seas exposed to wave action including a buoyancy section, an anchor section which rests on the sea bed, and a plurality of parallel tethers connecting the buoyancy section with said anchor section to permit the buoyancy section to move relative to the anchor section, in which the natural periods of oscillation follow specified equations such that the value of the parameters is so selected that the natural period of the buoyancy section for linear oscillation in the direction of wave travel, the natural period of the buoyancy section for linear oscillation in a horizontal direction perpendicular to the direction of wave travel, and the natural period of the buoyancy section for rotational oscillation about a vertical axis of said buoyancy section structure are greater than 50 seconds.

54 Claims, 7 Drawing Figures

WAVE HEIGHT (FEET)
120
100
80
60
40
20
0
PERIOD (SEC)
10
20
30
40
50
60
70
80
90
100
RANGE OF SEA WAVE PERIODS
NATURAL YAW PERIOD
NATURAL SURGE AND SWAY PERIOD
YAWING UNSTABLE
SURGING & SWAYING UNSTABLE
YAWING UNSTABLE
SURGING & SWAYING UNSTABLE

TENSION LEG BUOYANCY STRUCTURE

This invention relates to marine structures. In particular, it relates to structures located, or suitable for being located, over a fixed position on the sea bed.

Throughout the Specification, the term "sea" is used to refer not only to seas and oceans proper, but also to lakes or other large bodies of water. The term "marine" is used throughout the Specification in an analogous sense.

For a number of purposes, for example, for carrying out drilling operations on the sea bed or for withdrawing oil or natural gas from a previously drilled bore hole, it is necessary to provide a structure that can be maintained over a fixed position on the sea bed. Such structures may be divided into two broadly different categories in accordance with whether they are supported wholly or partly by their own buoyancy. Any structure that is partly immersed in water experiences a buoyancy force, but that may or may not suffice to support the entire weight of the structure. If the buoyancy force does not support the entire weight so that the structure is not self-buoyant, then the structure rests on the sea bed.

Self-buoyant structures can be further divided into two categories: those whose buoyancy exactly equals their weight (including the weight of the unsupported parts of their mooring lines), and those whose buoyancy exceeds this. Structures in the latter category have what can be regarded as a measure of excess buoyancy which is balanced by the tension in their mooring lines, or by a downward pull at one or more articulated joints attaching them to the sea bed, or to an anchor section on the sea bed. These excess buoyancy structures, which may also be referred to (and are referred to throughout this Specification) as tension leg structures, may have a working platform situated above the sea surface by means of a buoyancy chamber that is situated below the surface and from which supporting means extend upwardly to the working platform.

The supporting means for the working platform may be either open lattice type structures which contribute little to the overall buoyancy, or hollow cylindrical or other shaped members which contribute significantly to the overall buoyancy. The present invention is concerned with tension leg structures having either of the above types of supporting means.

If the supporting means are of the lattice type then the structure would be statically unstable in the absence of the tethers, that is to say, if the tethers were cut, the structure would float in an inverted position with the buoyancy chamber above and the working platform below. When the working platform supporting means are themselves buoyant the structure may or may not be statically stable in the absence of the tethers, and the invention is concerned with tension leg structures for which either of those conditions obtains.

Hitherto, vessels of the kind considered hereinbefore and semi-submersibles have been used by the oil industry primarily for exploration purposes. For production installations, structures that are not self-buoyant have been used, but they become economically very unattractive for use at depths of more than about 600 or 700 feet. For operation at greater depths, tension leg structures offer very substantial advantages.

In a tension leg structure, the tethers, which must be at least three in number, may be arranged in many different formations. They may, for example, all be parallel (so that they are vertical in the equilibrium position), or they may all be inclined at a large angle to the vertical or both types of tether may be used. Each configuration of tethers has its own advantages and disadvantages. For example, if the tethers are at a large angle to the vertical, the anchor points are separated by a large horizontal distance from the tethered portion. The tethered portion, will, nevertheless, be held firmly and will not easily be displaced from its equilibrium position provided that there are at least six suitably arranged tethers. The anchor points will, however, then have to contend with large horizontal components of tethering forces and, if they rely on friction with the sea bed to prevent them moving, they will need to be very heavy. By contrast, structures having parallel tethers will not have any restraining horizontal forces acting on the tethered portion when in equilibrium in a calm sea. There will be a restoring force when the tethered portions are displaced sideways, which restoring force is analogous to the force acting on a pendulum displaced from its central position, but, in the absence of a steady current, there will be no constant horizontal forces acting on the anchor section. Structures having parallel tethers can have a compact anchor section which, when viewed in plan, is comparable in shape and size to the buoyancy chamber.

In a tension leg structure having non-vertical tethers the dynamics of the structure when at sea is dominated by the stiffness of the system of tethers. A structure having parallel tethers, on the other hand, has dynamic properties dominated by the inertia of the tethered portion.

Structures with parallel tethers are much cheaper to construct than those with tethers making a large angle to the vertical but their dynamic behaviour under sea conditions needs very careful consideration if they are to be designed successfully.

Objects and advantages of the invention will become more apparent to those persons having ordinary skill in the art to which the present invention pertains from the following description taken in conjunction with the accompanying drawings wherein.

Figure 1:
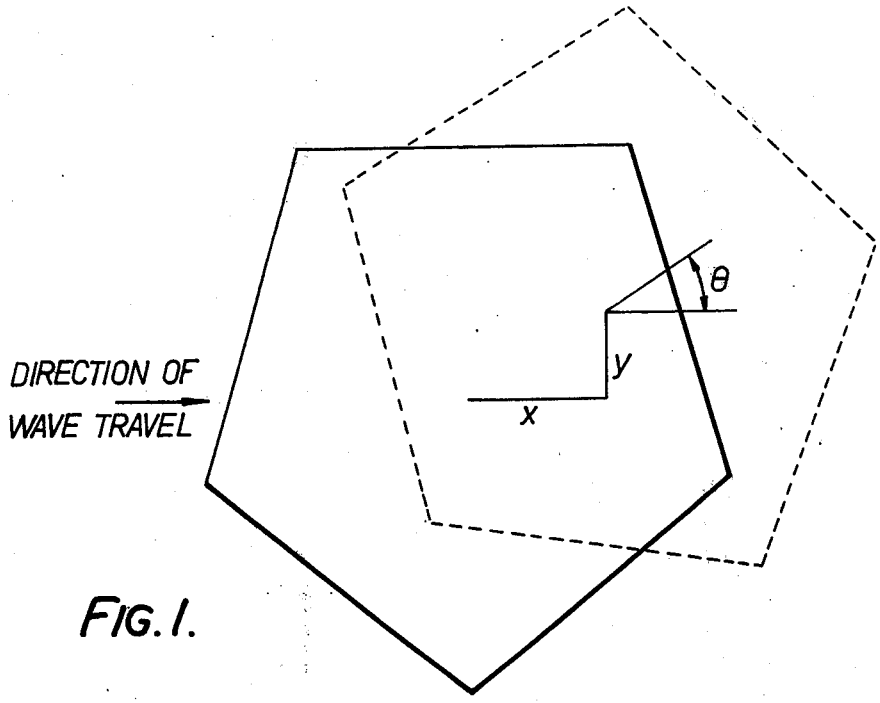
FIG. 1 is a plan view of a pentagonal self-buoyant structure showing horizontal displacement.

The invention is based, at least in part, on a realisation of the fact that the dynamic stability under sea conditions of a tension leg structure with parallel tethers (the possible displacements of the tethered portion of such a structure are indicated in FIG. 1 of the accompanying drawings) depends upon the natural periods of three different types of oscillation which the tethered portion of the structure can undergo. The three types of oscillation are linear oscillations in the direction of wave travel, linear oscillations in a horizontal direction perpendicular to the direction of wave travel and rotational oscillations about the vertical axis of the structure, respectively.

The invention provides a tension leg structure with parallel tethers in which the aforesaid natural periods are each at least 50 seconds.

Advantageously, the aforesaid natural periods are at least 60 seconds.

Advantageously, at least the aforesaid natural periods for linear oscillations are each greater than 80 seconds. Preferably, the aforesaid natural periods for linear oscillations are materially different from the natural period for rotational oscillations, advantageously by at least 10 seconds and preferably by at least 20 seconds.

As is explained hereinbefore, the dynamic behaviour of a tension leg structure is dominated by the inertia of the tethered portion. The inertia of the tethered portion, however, is to be considered not merely in terms of the mass, and the moment of inertia about its vertical axis, of the tethered portion considered in vacuo, but must also take into account an effective added mass and an effective added moment of inertia resulting from interaction between the tethered portion and the surrounding water. The nature and magnitudes of the added mass and the added moment of inertia are discussed in greater detail hereinafter, but it will be appreciated that they are functions of the size and shape of the immersed part of the tethered portion. Further, because the interaction between the tethered portion and the water will depend on the direction of relative movement between the tethered portion and the water, the added mass will also depend on that direction and it is therefore possible to refer to a vertical added mass (the added mass for vertical relative movement) and a horizontal added mass or horizontal added masses (the added mass or masses for horizontal relative movements in one or more dirctions).

It has been found that it is desirable to make the vertical added mass of the tethered portion small and the horizontal added mass or masses of the tethered portion large, which means that the area of the immersed part of the tethered portion that is presented to the water when the tethered portion moves horizontally should be large while the corresponding area for vertical movement should be small.

When, as will usually be the case in practice, the tension leg structure includes a buoyant chamber that is effectively rectangular in plan and in elevation, or is made up of a plurality of portions of that shape, the height of the buoyant chamber, or of each such portion, is advantageously more than 2.5 times the width of the chamber or of the said portion respectively. If the buoyant chamber is not of that form, so that it or its component portions are not of constant height and/or not of constant width, then the height and width above referred to can in practice generally be replaced by the square root of the mean square of the height and the square root of the mean square of the width, respectively. The upper limit for the height/width ratio is determined by the requirement that the buoyant chamber shall have sufficiently large structural strength.

It has also been found that it is desirable to make the added moment of inertia of the tethered portion of the structure large. Advantageously, this is achieved, at least in part, by the use of vanes secured to the buoyant chamber which, over at least a part of their horizontal length, have surfaces that extend radially, or in a direction having a radial component, with respect to the vertical axis about which the tethered portion can oscillate. Although outwardly extending vanes would in principle be more effective, for considerations of structural strength the vanes preferably extend, when the configuration of the buoyant chamber so permits, into a space enclosed by the buoyant chamber. In this way, the vanes may serve to brace, and so increase the structural strength of, the buoyant chamber. The vanes preferably extend at least the full height of the buoyant chamber and they may be so constructed that they are just self-buoyant.

The added moment of inertia may be at least equal to the moment of inertia of the tethered portion per se, and it is advantageously at least twice, preferably at least three times, the moment of inertia of the tethered portion per se.

Advantageously, the buoyant chamber is made up, or can be regarded as being made up of (it may be of integral construction) a plurality of portions each of which is substantially rectangular in plan and which are arranged to form a polygon, preferably, a regular polygon, of more than three sides. Preferably, the tethers are secured to the buoyant chamber at the apices of the polygon and a buoyant chamber in the form of a regular pentagon (or a regular polygon having more than five sides) is then preferred because it can then be arranged that the structure remains statically stable even if one tether fails. When, as is referred to hereinbefore, the buoyant chamber is provided with vanes, these advantageously extend within the polygon, preferably between non-adjacent apices of the polygon. Thus, there may be provided a vane extending between each pair of non-adjacent apices of the polygon.

The structure, consisting of the tethered portion and the tethers and, generally, an anchor portion, will usually be assembled at the site where it is to operate. The invention extends, however, to the tethered portion per se, and to the buoyant chamber per se (including any vanes secured thereto as hereinbefore specified).

The tethered portion per se and the buoyant chamber per se do not, of course, have determined natural periods of oscillation because the periods will depend on the length of the tethers, but for the purpose of ascertaining whether the tethered portions per se or the buoyant chamber per se falls within the scope of the invention, the aforesaid natural periods are to be determined on the assumption that the length of each of the tethers is 1000 feet. Preferably, the requirements for the aforesaid natural periods will be satisfied if the length of each of the tethers is 400 feet.

Prior to being transported to the site where the structure is to operate, the tethered portion may be "collapsed", that is to say, the pillars or legs on which the platform is supported may be removed or of reduced height, but the aforesaid natural periods of the tethered portion are to be determined with reference to the erected or non-collapsed condition of the tethered portion.

The use of parallel tethers makes it possible to use only a single anchor member and the invention also provides an anchor structure suitable for securing the lower ends of all the tethers of a tension leg structure in accordance with the invention. Advantageously, at least when the buoyant chamber is polygonal, the anchor structure is of polygonal, preferably, regular polygonal, form and has means for securing the lower ends of the tethers, preferably, at or close to the apices of the polygon.

As is explained hereinafter, it has been found that the dynamic stability of the structure is improved if the length of the tethers is increased and accordingly the tethers are advantageously secured to the anchor portion at or towards the bottom thereof. Thus, when the anchor portion consists of a single anchor structure, means for securing the lower ends of the tethers are advantageously situated at or towards the bottom of the anchor structure.

Although it is necessarily an over-simplification in certain respects, it is believed that the following analysis correctly represents the dynamic behaviour characteristics of a tension leg structure with parallel tethers under sea conditions.

In the analysis, the following symbols are used:

$a_c$=horizontal acceleration of the tethered portion of the structure $a_w$=horizontal acceleration of the water at the position of the structure if the structure were not there B=net upthrust on structure=(buoyancy minus weight)=$\rho D-M_o$=total tension force in the tethers D=volume of water displaced by the immersed part of the tethered portion of the structure F=amplitude of the time-varying component of the total tension in the tethers g=acceleration due to gravity $I=I_O+I_V$ $I_O$=moment of inertia of the tethered portion of the structure with respect to the axis about which the tethered portion can oscillate $I_V$=added moment of inertia of the tethered portion of the structure with respect to the axis about which the tethered portion can oscillate $M=M_O+M_H$ $M_O$=mass of the tethered portion of the structure $M_H$=horizontal added mass of the immersed part of the tethered portion of the structure $M_V$=vertical added mass of the immersed part of the tethered portion of the structure $R_{Vmax}$=largest vertical force exerted on the tethered portion of the structure in extreme storm waves r=distance from the tether attachment points to the vertical axis of symmetry s=length of each of the tethers t=time x=displacement of the tethered portion from its equilibrium position in the direction of wave travel y=displacement of the tethered portion from its equilibrium position in a direction perpendicular to the direction of wave travel $\beta$=is a positive constant defined by the equation $B=(1+\beta)R_{Vmax}$ $\epsilon_x(t)$, $\epsilon_y(t)$, $\epsilon_\theta(t)$=the exciting forces of the tethered portions in the x, y and $\theta$ directions, respectively $\theta$=the angular displacement of the tethered portions from its equilibrium position about its vertical axis $\omega=2\pi\times$frequency of waves $\rho$=water density $\tau_x$, $\tau_y$, $\tau_\theta$=periods of oscillation of the tethered portion in the x, y and $\theta$ directions, respectively.

It is well known that when a train of waves passes over the sea surface the water is disturbed at all depths although the amplitude of the motion attenuates with depth. The movement of the water is accompanied by a moving pressure field which likewise attenuates with depth. It is useful, in order to take advantage of this attenuation of amplitude with depth, if the buoyant chamber is immersed to a considerable depth, for example, if the buoyant chamber (at mid height) is immersed to a depth of about 200 to 250 feet. The attenuation for storm waves having an amplitude of 100 feet and a wave length of 1,500 feet in a water depth of 700 feet is then about 50%, and it is greater than that for deeper water, and for waves of shorter wavelength.

The acceleration of water in the vicinity of a submerged body, during the passage of waves, will cause forces to act on the body. These forces, collectively known as the inertia forces, are of two types. The first known as the Froude-Krylov force, is proportional to the mass of water displaced and its magnitude is given by $\rho Da_w$. The Froude-Krylov force arises because, if the body were not present, the water that would have been displaced by the body would be accelerated and must therefore be subject to a force. When the body is present, it must be subject to the same forces normal to the surface of the body that would have acted in those directions if the body had not been there. The resultant of those forces is the Froude-Krylov force, which can be seen to be a dynamic equivalent of the static buoyancy force. The second force acts when the submerged body is restrained so that there is relative movement between it and the water in its vicinity. The magnitude of this force is conveniently given as the product of the difference in acceleration between the submerged body and the water, and a certain mass. This mass is referred to as the added mass and is equal to twice the kinetic energy of the water movements caused by the submerged body divided by the square of the velocity of the body relative to the water at infinity.

The magnitude of the added mass will depend on the relative direction of motion between the body and the water and, in particular, it is possible to distinguish $M_H$ and $M_V$, and values it has for horizontal and vertical relative motions, respectively. On a typical tension leg structure the inertia force on the tethered portion may amount to several thousand tons under storm conditions, and greatly exceeds any drag forces which will be acting on the structure as a result of the viscosity of the water.

During the passage of a wave, it is well known that each particle of water executes an elliptic orbit, the ellipse approximating to a circle in water which is deep in comparison with the wavelength. This means that every particle of water is in continuous acceleration and any submerged body is acted upon continually by inertia forces of the types discussed above. The direction of the inertia force will be changing continually and can be represented by a vector rotating in a vertical plane. For a structure of the type under consideration, the tethers will prevent any appreciable vertical motion of the tethered portions under the action of the vertical component of the inertia force, but will allow sway from side to side caused by horizontal component of the inertia force.

The tethered portion will thus be thrown into forced oscillations in a horizontal plane and the tension in the tethers will continually be changing also under the action of the vertical wave forces. The oscillations may take the form of horizontal displacements or rotational displacements about a vertical axis.

The theory of motion of a body moving horizontally under the action of fluid forces is much simplified if the cross-section of the body in any horizontal plane is a regular polygon. For such a body the force coming onto it from the waves is always in the vertical plane perpendicular to the line of the wave crests (see, for example, Ch. VI, Section 126, paragraph 4, of Lamb's "Hydrodynamics", where it is indicated that this property can be deduced from the expression for the kinetic energy of the fluid). If advantage is taken of this fact, then the equations of motion in the various directions of displacement become independent of each other providing also that the weight of the tethered portion is so distributed that the vertical axis of symmetry is a principal axis of inertia on which lies the centre of gravity of the buoyancy chamber and the other parts of the tethered portion of the structure. It then follows that the differential equations describing the motion of the tethered portion have a particularly simple form; ignoring the small terms that result from inequalities between cable tensions. The equations for the motion of the tethered portion in a regular train of linear waves are:

$$\left.\begin{aligned} M\frac{d^2x}{dt^2} + \frac{1}{s}(B + F\sin\omega t)\,x &= \epsilon_x(t) \\ M\frac{d^2y}{dt^2} + \frac{1}{s}(B + F\sin\omega t)\,y &= \epsilon_y(t) \\ I\frac{d^2\theta}{dt^2} + \frac{1}{s}(B + F\sin\omega t)\,r^2\sin\theta &= \epsilon_\theta(t) \end{aligned}\right\} \quad (1)$$

These differential equations are (at least when $\theta$ is sufficiently small for it to be true that sin $\theta$ $\theta$) in the mathematical sense time-varying linear equations. This has the important advantage that the solution can be expressed as the sum of a complementary function (that is to say, the solution of the equations with $\epsilon_x(t)=\epsilon_y(t)=\epsilon_\theta(t)=0$) and a particular integral (that is to say, any solution of the equations as they stand).

Figure 2:
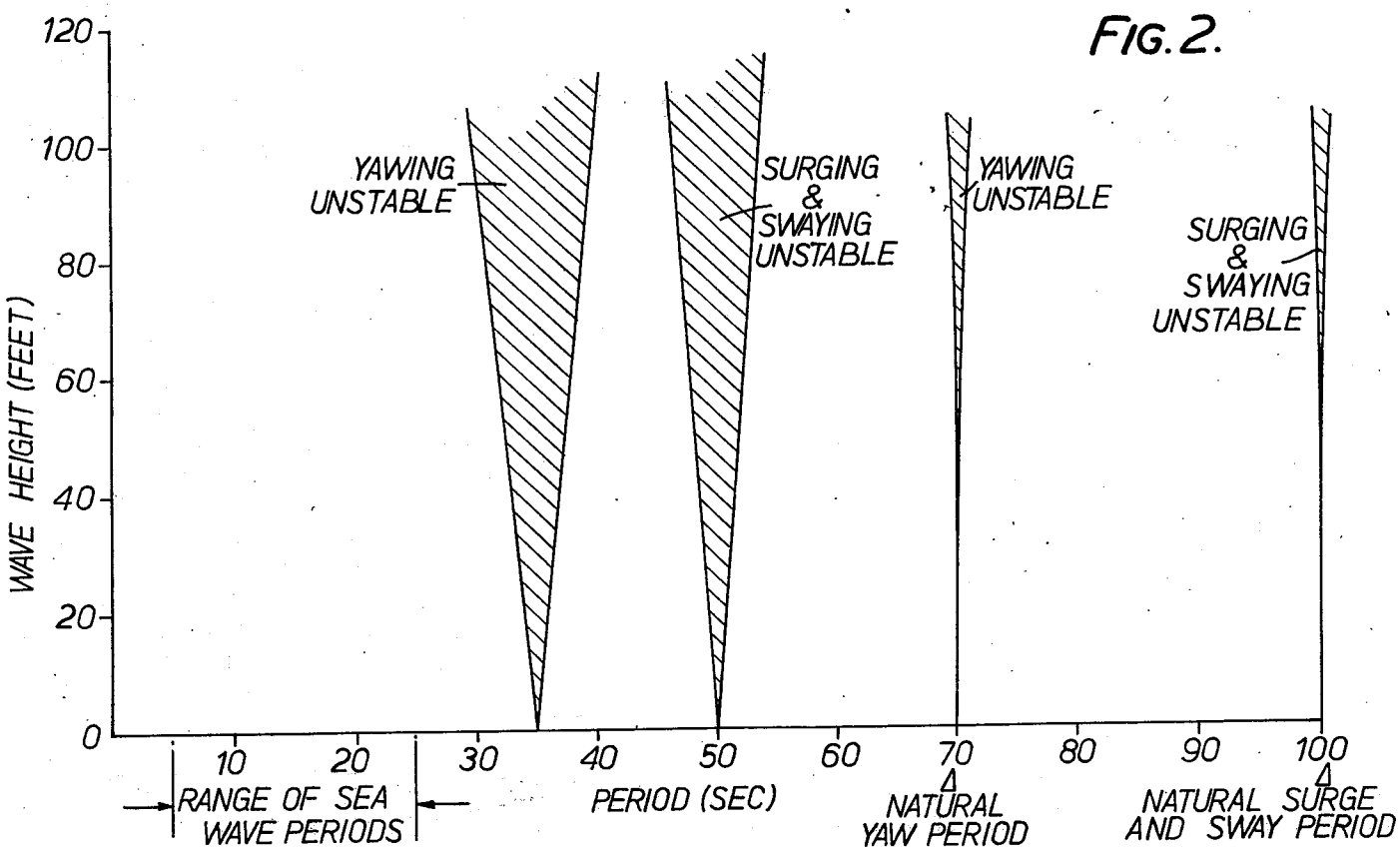
FIG. 2 is a graph disclosing stable and unstable conditions.

Putting $\epsilon_x(t)=\epsilon_y(t)=\epsilon_\theta(t)=0$ in (1) gives three independent Mathieu equations. Mathieu's equation is remarkable for having exponentially growing oscillatory solutions at the platform frequency when $\omega$ is at or near 2/n times the natural (still water) frequency of oscillation where n is a positive integer and it is possible to draw a stability diagram, an example of which is shown in FIG. 2 of the accompanying drawings. Referring to FIG. 2, the stability diagram shows those combinations of period and wave-amplitude that, for a particular structure, lead to instability (that is to say, to exponentially growing oscillations) and those that do not.

In the stable regions of the diagram, the magnitude of the motions of the tethered portion in the direction of wave-travel can be calculated from a knowledge of the forcing functions $\epsilon$.

The still water periods of the tethered portions derived from eqs. (1) by putting F=O are given by:

$$\tau_x = \tau_y = 2\pi\sqrt{\frac{sM}{B}} = 2\pi\sqrt{\frac{sM}{(\rho D - M_o)}} \quad (2)$$

$$\tau_\theta = 2\pi\sqrt{\frac{sI}{Br^2}} = 2\pi\sqrt{\frac{sI}{(\rho D - M_o)r^2}} \quad (3)$$

In practice, the tethers must not be allowed to go slack. This means that they must be given a sufficient reserve of tension for the tension to remain positive even in storm conditions of the kind referred to hereinbefore. Suppose $R_{Vmax}$ is the largest vertical force which such a storm wave will exert on the structure then B must always exceed $R_{Vmax}$. Suppose we write $B=(1+\beta)R_{Vmax}$ where $\beta$ is an arbitrarily chosen positive constant which might typically be 0.5 in practice. Let $a_{vmax}$ be the maximum vertical water acceleration causing the force $R_{Vmax}$ to act vertically on the tethered portions. Then $$R_{Vmax}=a_{Vmax}(\rho D+M_v) \quad (4)$$

so that $$B=(1+\beta)R_{Vmax}=(1+\beta)a_{Vmax}(\rho D+M_v) \quad (5)$$

$$\tau_x = \tau_y = 2\pi\sqrt{\frac{s(M_o + M_H)}{(1+\beta)\alpha_{vmax}(\rho D + M_v)}} \quad (6)$$

$$\tau_\theta = 2\pi\sqrt{\frac{s(I_o + I_v)}{(1+\beta)a_{vmax}(\rho D + M_v)r^2}} \quad (7)$$

It is shown hereinbefore that Mathieu-type instabilities would be expected to occur when the wave frequency is 2/n times the natural frequency or, what is the same thing, the wave period $2\pi/\omega$ is n/2 times any of the periods $\tau_x$, $\tau_y$ and $\tau_\theta$ n being a positive integer.

Figure 3:
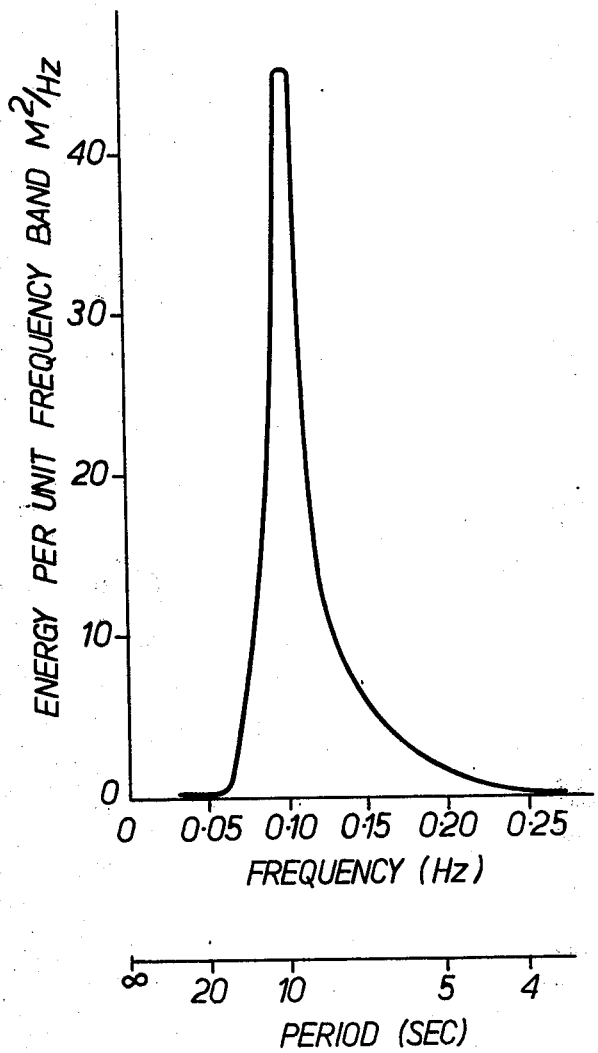
FIG. 3 is a graph disclosing the energy and frequencies of waves in the North Sea.

It is known that, in the sea, the energy per unit frequency is concentrated in a band of frequencies and that there is very little energy indeed at frequencies smaller than 1/25 $sec^{-1}$, that is to say, for periods exceeding 25 seconds, or at frequencies greater than 1/5 $sec^{-1}$, that is to say, for periods less than 5 seconds. That is illustrated in FIG. 3, which shows a typical sea wave spectrum for the North Sea. This means that for periods exceeding 25 seconds the forcing functions $\epsilon_x(t)$, $\epsilon_y(t)$, $\epsilon_\theta(t)$ arising from the motion of the sea are very small, and, what is more important, the amplitude F of the modulating term is small and the energy available to build up oscillations of the tethered portion is very low.

The theory of Mathieu instability outlined above has been presented with reference to structures having a regular polygonal form and subjected to a regular train of sinusoidal waves. The occurrence of Mathieu instabilities is, however, dependent on neither of the above restrictions. Thus, in the equation of motion, eqs. (1), the instabilities arise due to the presence of terms of the form $(B+F\sin\omega t)x$. Instabilities will still occur in the more general case when the above term is replaced by $[B+g(t)]x$, where g (t) is a vertical force which varies with time. More complicated shapes of structure will give rise to equations having more terms than eqs. (1) but the presence of the time varying terms will still give the possibility of instabilities.

Furthermore, the discussion set out hereinafter on how to minimise the risk of instabilities will apply to bodies of more complex shape. An actual structure might, for example, be rectangular in plan form, which gives it two planes of symmetry, or be built from two parallel submerged chambers that were such that it would have only one plane of symmetry, or it might have no symmetry at all. Each of the above possibilities results in a progressively more complex set of equations of motion. In particular, the added mass may be different in different directions relative to the body, although it may be shown that, by appropriate choise of axes, only two horizontal added masses are required even to deal with the most complex shapes.

The considerations outlined hereinafter are equally applicable to structures having lower degrees of symmetry than regular polygons, bearing in mind that two horizontal masses may have to be considered and that the two periods of oscillation $\tau_x$ and $\tau_y$ may no longer be equal for such cases.

The discussion set out hereinafter also applies to cases where the centre of gravity of the tethered portion and the centre of buoyancy do not lie on the same vertical line or coincide with a vertical axis of symmetry.

The arguments set out hereinbefore have been derived from equations of motion in which there are no damping terms. It is known, practically, that damping reduces the areas of instability shown in FIG. 2 (see H. N. Abramson, "The Dynamic Behaviour of Liquids in Moving Containers", p. 284, NASA Publication NASA SP-106, 1966). In a real tension leg structure, therefore, the instability zones will stop short of actually intersecting the period axis. If, therefore, the periods $\tau_x$, $\tau_y$ and $\tau_\theta$ can be made 50 seconds or more, preferably, 60 seconds, or more, the motion will remain within the stable zone. Practically, therefore, the oscillations will not increase exponentially, provided that the natural period of the platform is greater than 50 or 60 seconds.

Examinations of equations (6) and (7) shows that long periods will be assisted by:

(a) making $\beta$, D, $M_V$ and r each as small as possible; and (b) making s, $M_O$, $M_H$, $I_O$ and $I_V$ each as large as possible. Each of these parameters will now be considered in turn.

$\beta$ This is an arbitrary safety factor. It must be large enough to give a margin of positive tension in the cables under the worst storm conditions for which the structure is being designed and it is not likely in practice to be possible to make it less than 0.3.

D There are two constraints on D. The first is that $\rho D - M_o > O$ and the second arises from the need to provide sufficient structural strength having regard to the value of $M_O$ and the magnitude of the load to the working platform. In practice, there is not much possibility of making D very small.

$M_V$ This quantity may be reduced by arranging that the buoyancy chamber has a small plan area. Since the vertical added mass is proportional to the square of the plan width of the buoyant chamber or of each portion of the buoyant chamber, there is considerable advantage in reducing that dimension.

r In general, r cannot be much reduced without loss of static stability. r will thus usually be the distance from the centre of the structure to the towers on the structure periphery.

s This is largely dictated by the water depth. However, some improvement can be gained by making the cable attachments at sea bed level and not at the top of the anchor position.

$M_O$ This has already been discussed under D.

$M_H$ This may be increased by increasing the dimensions of the buoyant chamber, or each portion of the buoyant chamber, as seen from the side. In particular, for portions of a given length, which length will be dictated by the overall size of the structure, it will be advantageous to increase the vertical dimension of the buoyant chamber as much as possible. Since the added mass in the horizontal direction depends on the square of the chamber height, considerable mass may be added by this means. Horizontal added mass will also result from the provision of vanes as herein described.

$I_O$ As for $M_O$, the value of the structural moment of inertia will be largely dominated by structural strength considerations but within these considerations should be made as large as possible by trying to keep structural mass on the periphery.

$I_V$ Here, as for $M_H$, the use of a deep buoyant chamber will help to make $I_V$ large. In addition, the provision of vanes as hereinbefore described can be arranged to provide a large added horizontal mass at a large radius from the vertical axis of the structure and so give a large $I_V$. The vanes should be as tall as possible.

One further design point can be inferred from the analysis set out hereinbefore. The excitation coming from the sea will generally be much greater in one direction than in any other. Thus, as the disturbance is presumed to be along the Ox direction, $\epsilon_y(t)$ and $\epsilon_\theta(t)$ will be much less than $\epsilon_x(t)$. But $\epsilon_y(t)$ is dependent on $\sin\theta$ and $\epsilon_\theta(t)$ is dependent on y. The tethered portions should preferably, therefore, be arranged to have different natural frequencies for translation and rotation so as to avoid any feeding of energy between the two modes.

One feature of the type of structure analysed hereinbefore is that, because of the deliberate adding of horizontal mass to the buoyant chamber, the motion of the tethered portion of the structure will be very nearly the same as that of the water at the depth of the buoyant chamber. This means that, when tension leg structures are used for oil or natural gas production, the oil or gas risers which bring up the oil from the sea bed, will also move with the water at their top ends, if they are attached to the buoyant chamber. They will thus not be subject to the drag forces that would arise if there were a greater relative movement between the buoyant chamber and the water.

Nevertheless, because of the movement of the tethered portions, stresses will be induced in the risers.

It has been found that these stresses become large at the top and bottom ends of the risers. As a consequence it will generally be found necessary to instal universal joints at both ends of the risers.

It is also known that, in order to reduce the maximum stress in a riser, it is advantageous to apply top tension to it. Thus, the optimum tension will exceed the tension required merely to support the weight of the suspended pipe. This tension, insofar as it exceeds the weight of the pipe, will have to be resisted at the lower end of the pipe. As a consequence, the anchor portion will require to be constructed to resist the upward pull from the risers.

Figure 4:
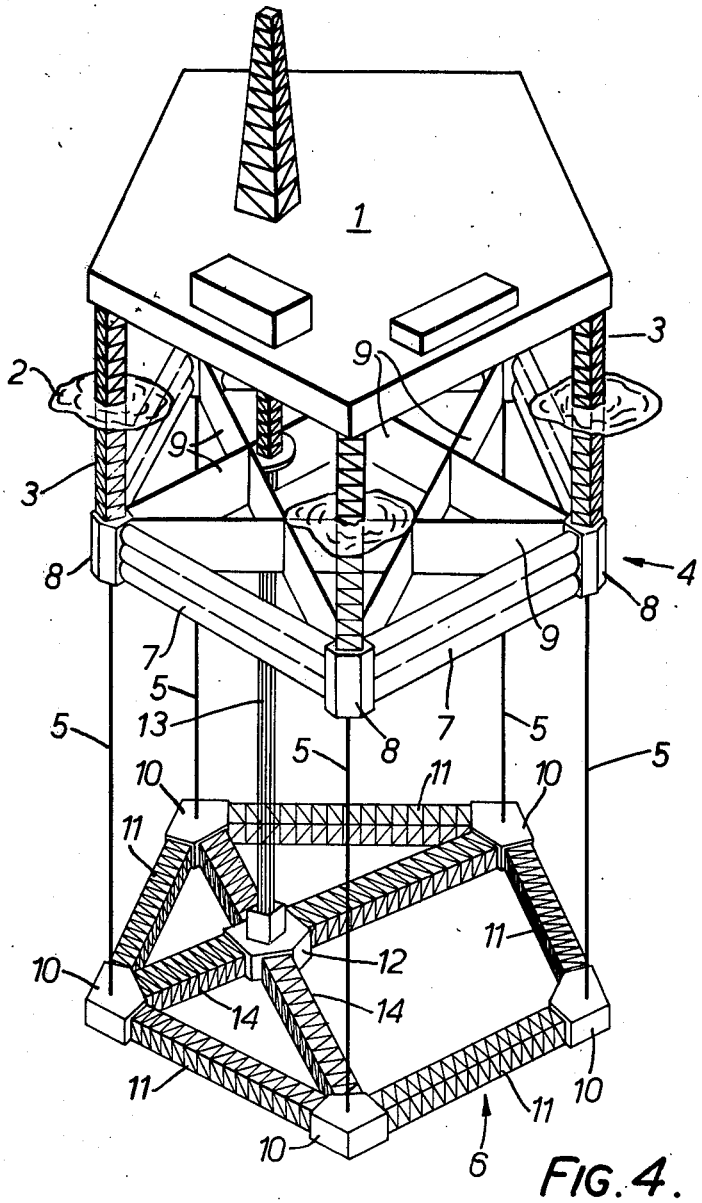
FIG. 4 is a perspective view of a tension leg buoyancy structure according to the present invention.

Referring to FIG. 4 of the accompanying drawings, the structure comprises a working platform 1, which is supported above the surface of the sea, which is shown at 2, by five support towers 3 which extend upwardly from a buoyant chamber, which is indicated generally by the reference numeral 4. The buoyant chamber 4 is secured by means of tethers to an anchor portion, which is indicated generally by the reference numeral 6.

Figure 5:
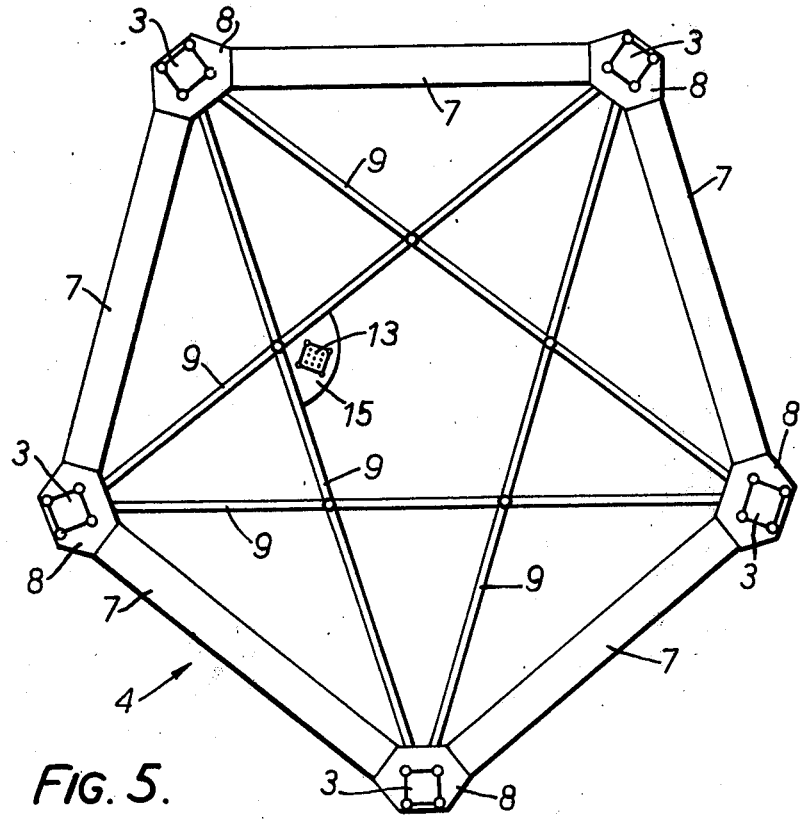
FIG. 5 is a top view of a buoyancy section according to the present invention.

Referring to FIG. 5, the buoyant chamber 4 comprises five portions 7, which are rectangular both in side elevation and in plan and which are so arranged that their longitudinal axes substantially form the sides of a regular pentagon. The portions 7 are joined together at their ends by apex portions 8 from which the five support towers 3 extend vertically upwards.

The apex portions 8 of each pair of non-adjacent apex portions are interconnected by one of five laminar vanes 9. The laminar vanes extend over the whole height of the buoyant chamber 4 and are themselves just self-buoyant.

The five tethers 5 extend parallel to one another from the undersides of the apex portions 8 of the buoyant chamber 4 to the base of an anchor portion 6, which is itself of generally pentagonal form and which, in plane, is of only slightly larger dimensions than the buoyant chamber 4 and the working platform 1.

Figure 6:
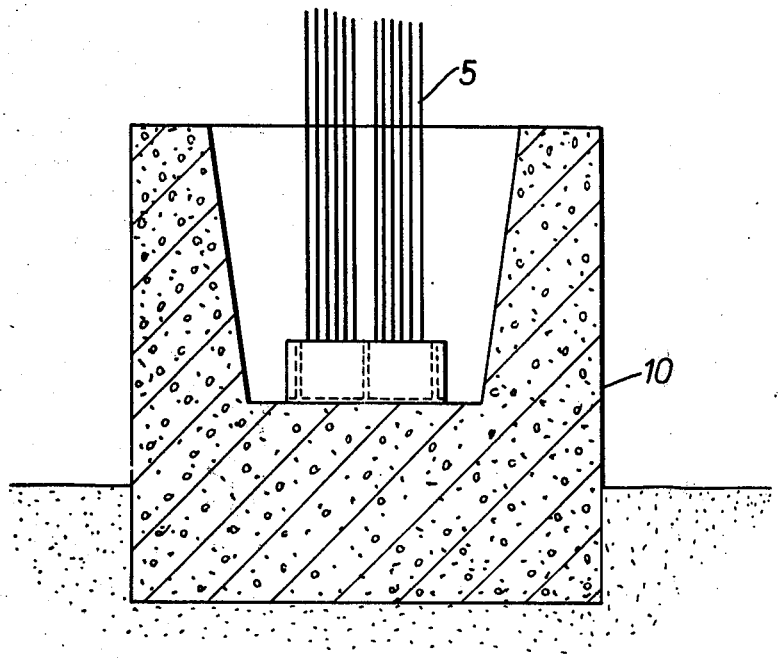
FIG. 6 is a sectional view of a concrete anchor member according to the present invention.
Figure 7:
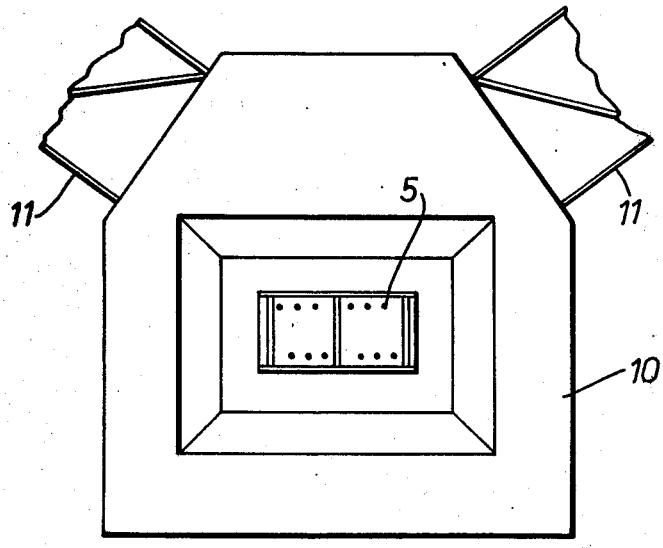
FIG. 7 is a top view of the anchor member shown in FIG. 6.

The anchor portion 6 is made up of five concrete members 10 interconnected by girders 11. The concrete members 10 and the girders 11 together form a generally pentagonal structure, and, in plan, it is of approximately the same shape as the buoyant chamber 4. The lower ends of the tethers 5 are secured close to the bottom of the concrete members 10. For this purpose the concrete members are formed with depressions having such a form that chafing of the tethers 5 on the anchor section 6, is avoided (see FIGS. 6 and 7).

The anchor section also comprises a heavy concrete block 12 to resist the upward tension in risers 13 and this block is located relative to the rest of the anchor portion by girders 14 joining it to the concrete members 10. The girders 14 serve conveniently to give rigidity to the anchor portion.

At their upper ends, the risers are secured to an attachment 15 to a pair of vanes 9 close to where the vanes intersect one another (see FIG. 5).

The structure operates in the following manner. The buoyancy of the submerged parts of the tethered portion is sufficiently great to exceed its weight and to give a sufficiently high tension in the tethers for the tethers never to go slack even when the wave forces on the structure are vertically downwards and in storm conditions of the kind specified hereinbefore.

Each of the portions 7 may be 50 feet high and 18 feet wide, so that they are then more than 2.5 times as high as they are wide. This has the consequence that, as is explained hereinbefore, there is considerable added horizonal mass and only relatively little added vertical mass. The tethers 5 may each be 400 feet in length and the anchor section 6 may be about 50 feet high. The buoyant chamber 4 may be immersed, at mid-height, to a depth of about 220 feet.

When the portions 7 of the buoyant chamber 4 are, as shown schematically in FIG. 4, not of uniform thickness, then their width is to be calculated in the manner explained hereinbefore and the figure of 18 feet referred to above is to be understood in that sense.

Each of the vanes 9 extends in a direction which, at the centre of the vane, is tangential to a circle of which the centre lies on the vertical axis of the structure but which direction, towards the ends of the vane, is more nearly radial with respect to such a circle. Remembering that only inertia forces and not drag forces are being considered so that only the component of movement of the vanes in a direction normal to their surfaces is of account, it can be seen that, for oscillation of the tethered portion of the structure about the said axis, the end portions of the vanes contribute substantial added horizontal mass and hence, since those portions of the vanes are remote from the axis of rotation, considerable added moment of inertia.

By reason of the large added horizontal mass, the large added moment of inertia about a vertical axis and the small added vertical mass, the structure can be arranged to be free from, or substantially free from, the Mathieu-type instabilities referred to hereinbefore. Thus, with the dimensions mentioned hereinbefore for the portions 7 and the length of the tethers 5, and making reasonable assumptions with regard to the other relevant parameters, an analysis of the kind outlined hereinbefore shows that the natural periods of the structure may be given by $\tau x = \tau y = 100$ seconds approximately; and $\tau\theta = 70$ seconds approximately.

Thus, the conditions for avoiding the Mathieu-type instabilities are avoided in that $\tau_x$, $\tau_y$, $\tau_\theta$ are each greater than 60 seconds, and $\tau_x$ and $\tau_y$ are each substantially different from $\tau_\theta$.

What we claim is:

1. A tension leg structure for use in seas exposed to wave action, said structure comprising a buoyancy section, an anchor section which rests on the sea bed, and a plurality of parallel tethers connecting said buoyancy section with said anchor section, said buoyancy section having a buoyant chamber substantially rectangular in plan and in elevation including one or more portions of that shape with the height of the buoyant chamber more than 2.5 times the width of the buoyant chamber and the height of each of the said portions of the buoyant chamber more than 2.5 times the width of each portion, said structure configured such that the natural period for linear oscillations in the direction of wave travel ($\tau_x$), the natural period for linear oscillations in the horizontal direction perpendicular to the direction of wave travel ($\tau_y$) and the natural period for rotational oscillations about the vertical axis of said structure ($\tau_\theta$) are each at least 50 seconds.

2. The tension leg structure according to claim 1, wherein $\tau_\theta > 60$ sec, $\tau_x > 60$ sec and $\tau_y > 60$ sec.

3. The tension leg according to claim 1, wherein $\tau_x > 80$ sec and $\tau_y > 80$ sec.

4. The tension leg structure according to claim 3, wherein said natural periods for linear oscillations each differ from said natural period for rotational oscillation by at least 10 seconds.

5. The tension leg structure according to claim 4, wherein the tethers are secured to the anchor section at or towards the bottom thereof.

6. The tension leg structure according to claim 3, wherein said natural periods for linear oscillations each differ from said natural period for rotational oscillations by at least 20 seconds.

7. The tension leg structure according to claim 1 wherein said buoyant chamber portions are arranged in a shape having at least one axis of symmetry.

8. The tension leg structure according to claim 7, wherein said shape is a polygon.

9. The tension leg structure according to claim 8, wherein the tethers are secured to the buoyant chamber at the apices of the polygon.

10. The tension leg structure as claimed in claim 9, wherein said polygon has at least five sides.

11. The tension leg structure according to claim 8, including vanes extending between non-adjacent apices of the polygon.

12. The tension leg structure according to claim 11 including a vane extending between each pair of non-adjacent apices of the polygon.

13. The tension leg structure according to claim 7, wherein said shape is a polygon having more than three sides.

14. The tension leg structure according to claim 7, wherein the tethers are secured to the anchor section at or towards the bottom thereof.

15. The tension leg structure according to claim 1 additionally including a buoyant chamber and vanes secured thereto, said vanes having primarily vertical surfaces extending generally radially with respect to the vertical axis about which the buoyancy section can oscillate thereby providing a horizontal interaction between the vanes and the water to increase the effective moment of inertia of the structure and the natural periods in the horizontal directions and about said vertical axis without adding mass in the vertical direction.

16. The tension leg structure according to claim 15, with said vanes extending within a space surrounded by said buoyant chamber.

17. The tension leg structure according to claim 15, with said vanes extending at least the full height of the buoyant chamber.

18. The tension leg structure according to claim 15, wherein the added moment of inertia of the buoyancy section of the structure with respect to the vertical axis about which the buoyancy section can oscillate is at least equal to the moment of inertia of the buoyancy section with respect to that axis.

19. The tension leg structure according to claim 15 including a buoyant chamber formed of a plurality of portions substantially rectangular in plan and arranged in a shape having at least one axis of symmetry.

20. The tension leg structure according to claim 19, wherein said shape is a polygon.

21. The tension leg structure according to claim 20, wherein the tethers are secured to the buoyant chamber at the apices of the polygon.

22. The tension leg structure according to claim 20 including a vane extending between each pair of non-adjacent apices of the polygon.

23. The tension leg structure of claim 1, wherein said buoyancy section has a buoyant chamber with vanes secured thereto, said vanes having surfaces extending generally radially with respect to the vertical axis about which the structure can oscillate and extending at least the full height of the buoyant chamber and increasing the moment of inertia of the buoyancy section.

24. The tension leg structure according to claim 23, with said vanes extending within a space surrounded by said buoyant chamber.

25. The tension leg structure according to claim 24, with said vanes positioned to reinforce the buoyant chamber.

26. The tension leg structure according to claim 23, wherein said vanes are just self-buoyant thereby decreasing the forces on the structure.

27. The tension leg structure according to claim 26, wherein the added moment of inertia of the buoyancy section is at least twice the moment of inertia of the buoyancy section.

28. The tension leg structure according to claim 23, wherein the added moment of inertia of the buoyancy section of the structure with respect to the vertical axis about which the buoyancy section can oscillate is at least equal to the moment of insertia of the buoyancy section with respect to that axis.

29. The tension leg structure according to claim 28, wherein the added moment of inertia of the buoyancy section is at least three times the moment of inertia of the buoyancy section.

30. The tension leg structure according to claim 23, wherein said buoyant chamber portions are arranged in a shape having at least one axis of symmetry.

31. The tension leg structure according to claim 30, wherein said shape is a polygon.

32. The tension leg structure according to claim 31, wherein the tethers are secured to the buoyant chamber at the apices of the polygon.

33. The tension leg structure according to claim 32, wherein said polygon has at least five sides.

34. The tension leg structure according to claim 31, including vanes extending between non-adjacent apices of the polygon.

35. The tension leg structure according to claim 34, including a vane extending between each pair of non-adjacent apices of the polygon.

36. The tension leg structure according to claim 30, wherein said shape is a polygon having more than three sides.

37. The tension leg structure according to claim 1, wherein the tethers are secured to the anchor section at or towards the bottom thereof.

38. A tension leg structure for use in seas exposed to wave action, said structure comprising a buoyancy section, an anchor section which rests on the sea bed, and a plurality of parallel tethers connecting said buoyancy section with said anchor section and said buoyancy section having a buoyant chamber with vanes secured thereto, said vanes having surfaces extending generally radially with respect to the vertical axis about which the structure can oscillate and extending at least the full height of the buoyant chamber and increasing the moment of inertia of the buoyancy section, said structure configured such that the natural period for linear oscillations in the direction of wave travel ($\tau_x$), the natural period for linear oscillations in a horizontal direction perpendicular to the direction of wave travel ($\tau_y$) and the natural period for rotational oscillation about the axis of said structure ($\tau_\theta$) are each at least 50 seconds.

39. The tension leg structure according to claim 38, with said vanes extending within a space surrounded by said buoyant chamber.

40. The tension leg structure according to claim 39, with said vanes positioned to reinforce the buoyant chamber.

41. The tension leg structure according to claim 38, wherein $\tau\theta > 60$ sec, $\tau_x > 60$ sec and $\tau_y > 60$ sec.

42. The tension leg structure according to claim 38, wherein $\tau_x > 80$ sec and $\tau_y > 80$ sec.

43. The tension leg structure according to claim 42, wherein said natural periods for linear oscillations each differ from said natural period for rotational oscillation by at least 10 seconds.

44. The tension leg structure according to claim 42, wherein said natural periods for linear oscillations each differ from said natural period for rotational oscillations by at least 20 seconds.

45. The tension leg structure according to claim 38, with said vanes extending at least the full height of the buoyant chamber.

46. The tension leg structure according to claim 38, wherein said vanes are just self-buoyant thereby decreasing the forces on the structure.

47. The tension leg structure according to claim 38, wherein the added moment of inertia of the buoyancy section of the structure with respect to the vertical axis about which the buoyancy section can oscillate is at least equal to the moment of inertia of the buoyancy section with respect to that axis.

48. The tension leg structure according to claim 47, wherein the added moment of inertia of the buoyancy section is at least three times the moment of inertia of the buoyancy section.

49. The tension leg structure according to claim 47, wherein the added moment of inertia of the buoyancy section is at least twice the moment of inertia of the buoyancy section.

50. The tension leg structure according to claim 38 including a buoyant chamber formed of a plurality of portions substantially rectangular in plan and arranged in a shape having at least one axis of symmetry.

51. The tension leg structure according to claim 50, wherein said shape is a polygon.

52. The tension leg structure according to claim 51, wherein the tethers are secured to the buoyant chamber at the apices of the polygon.

53. The tension leg structure according to claim 51, including a vane extending between each pair of non-adjacent apices of the polygon.

54. The tension leg structure according to claim 38, wherein the tethers are secured to the anchor section at or towards the bottom thereof.

* * * * *